US010665990B2

(12) United States Patent
Yamada et al.

(10) Patent No.: US 10,665,990 B2
(45) Date of Patent: May 26, 2020

(54) SERVICE PLUG WITH PREVENTATIVE WALL TO PREVENT CAM PIN FROM EJECTING FROM THE CAM GROOVE

(71) Applicant: YAZAKI CORPORATION, Tokyo (JP)

(72) Inventors: Go Yamada, Shizuoka (JP); Osamu Yanagisawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/011,658

(22) Filed: Jun. 19, 2018

(65) Prior Publication Data

US 2018/0366874 A1 Dec. 20, 2018

(30) Foreign Application Priority Data

Jun. 20, 2017 (JP) ..... 2017-120331

(51) Int. Cl.
*H01R 13/629* (2006.01)
*H01R 13/631* (2006.01)

(52) U.S. Cl.
CPC . *H01R 13/62938* (2013.01); *H01R 13/62905* (2013.01); *H01R 13/62977* (2013.01); *H01R 13/6315* (2013.01); *H01R 13/62955* (2013.01); *H01R 2201/26* (2013.01)

(58) Field of Classification Search
CPC ..... H01R 13/62938; H01R 13/62905; H01R 13/62955; H01R 13/6315; H01R 2201/26; H01R 13/62977; H01R 13/62983
USPC ..... 439/157, 259, 347, 372
See application file for complete search history.

(56) References Cited

U.S. PATENT DOCUMENTS 5,904,583 A 5/1999 Katsuma et al.
6,358,101 B1 * 3/2002 Noro ..... H01R 13/4362 439/145
6,644,992 B2 * 11/2003 Maegawa ..... H01R 13/62938 439/157
6,942,504 B2 * 9/2005 Shinozaki ..... H01R 13/62938 439/157
9,171,685 B2 * 10/2015 Henmi ..... H01H 35/003
(Continued)

FOREIGN PATENT DOCUMENTS

JP 7-29764 U 6/1995
JP 8-313582 A 11/1996
(Continued)

OTHER PUBLICATIONS

Korean Office Action for the related Korean Patent Application No. 10-2018-0068572 dated Mar. 8, 2019.
(Continued)

*Primary Examiner* — Travis S Chambers
(74) *Attorney, Agent, or Firm* — Kenealy Vaidya LLP

(57) ABSTRACT

A service plug includes a first connector housing, a second connector housing, and a lever that is rotatable about a rotational shaft on the second housing. The lever is movable between a first operating position and a second operating position. The second connector housing is in a non-fitted state, when the lever is in the first operating position. The second connector housing is in a fitted state, when the lever is in the second operating position. The lever includes a preventive wall at a terminating end portion of the cam groove.

6 Claims, 7 Drawing Sheets

(56) References Cited

U.S. PATENT DOCUMENTS

| | | | | |
|---|---|---|---|---|
| 2013/0065412 | A1 | 3/2013 | Ikeda et al. | |
| 2013/0237078 | A1* | 9/2013 | Ikeda | H01H 9/102 439/157 |
| 2014/0349499 | A1 | 11/2014 | Takatsu | |
| 2015/0079827 | A1* | 3/2015 | Hara | H01R 13/05 439/188 |
| 2015/0162698 | A1* | 6/2015 | Hara | H01R 13/518 439/157 |

FOREIGN PATENT DOCUMENTS

| | | | |
|---|---|---|---|
| JP | 2002-319333 | A | 10/2002 |
| JP | 2012-119292 | A | 6/2012 |
| JP | 2013-62043 | A | 4/2013 |
| JP | 2013-143209 | A | 7/2013 |
| JP | 2016-6754 | A | 1/2016 |

OTHER PUBLICATIONS

Japanese Office Action for the related Japanese Patent Application No. 2017-120331 dated Jun. 4, 2019.

* cited by examiner

SERVICE PLUG WITH PREVENTATIVE WALL TO PREVENT CAM PIN FROM EJECTING FROM THE CAM GROOVE

CROSS-REFERENCES TO RELATED APPLICATIONS

This application is based on and claims priority from Japanese Patent Applications No. 2017-120331 filed on Jun. 20, 2017, the entire contents of which are incorporated herein by reference.

BACKGROUND

1. Field of the Invention

The present invention relates to a service plug.

2. Description of Related Art

JP-A-2012-119292 discloses a service plug that includes a first connector housing mounted on a vehicle or the like, a second connector housing configured to be fitted over and removed from the first connector housing, and a lever rotatably mounted on the second connector housing to apply a force in a fitting direction and a removing direction of the second connector housing on and from the first connector housing.

This service plug is provided somewhere between a vehicle battery and a load. The service plug is designed so that the second connector housing is removed from the first connector housing together with the lever when an operator works on a side of the load, from a viewpoint of ensuring the operator's safety.

However, since the service plug of JP-A-2012-119292 is designed on the premise that a grip portion made up of the second connector housing and the lever is removed from the first connector housing, this requires a space above the service plug for removing the grip portion.

In addition, designing the grip portion to be removed produces a risk of the grip portion (the removal part) being dropped to be damaged for unavailability or a risk of a foreign matter intruding into the first connector housing whose interior is exposed.

SUMMARY

In accordance with embodiments, a service plug would obviate a necessity of a removal space and prevent a removal part from dropping to be damaged for unavailability or a foreign matter from intruding into an interior of a first connector housing.

In accordance with embodiments, a service plug includes a first connector housing including a cam pin, a second connector housing on which a rotatable shaft is provided, and a lever that is rotatable about the rotational shaft. The lever includes a cam groove in which the cam pin fits. The lever is movable between a first operating position and a second operating position. The second connector housing is in a non-fitted state with respect to the first connector housing, when the lever is in the first operating position. The second connector housing is in a fitted state with respect to the first connector housing, when the lever is in the second operating position. The lever includes a preventive wall at a terminating end portion of the cam groove. The preventive wall is configured to prevent the cam pin from ejecting from the cam groove in a moving direction of the second connector housing from the fitted state to the non-fitted state when the lever is in the first operating position.

Other aspects and advantages of the invention will be apparent from the following description and the appended claims.

DETAILED DESCRIPTION

Hereinafter, the invention will be described by reference to exemplary embodiments. It should be noted that the invention is not limited to the exemplary embodiments that will be described below, and hence, the exemplary embodiments can be modified or altered as required without departing from the spirit and scope of the invention. In the following embodiments, although the illustration and description of part of the configuration thereof are omitted, in relation to the details of an omitted technique or techniques, needless to say, publically known or well-known techniques are applied to the omitted technique or techniques within a scope where no contraction to the following description is generated.

Figure 1:
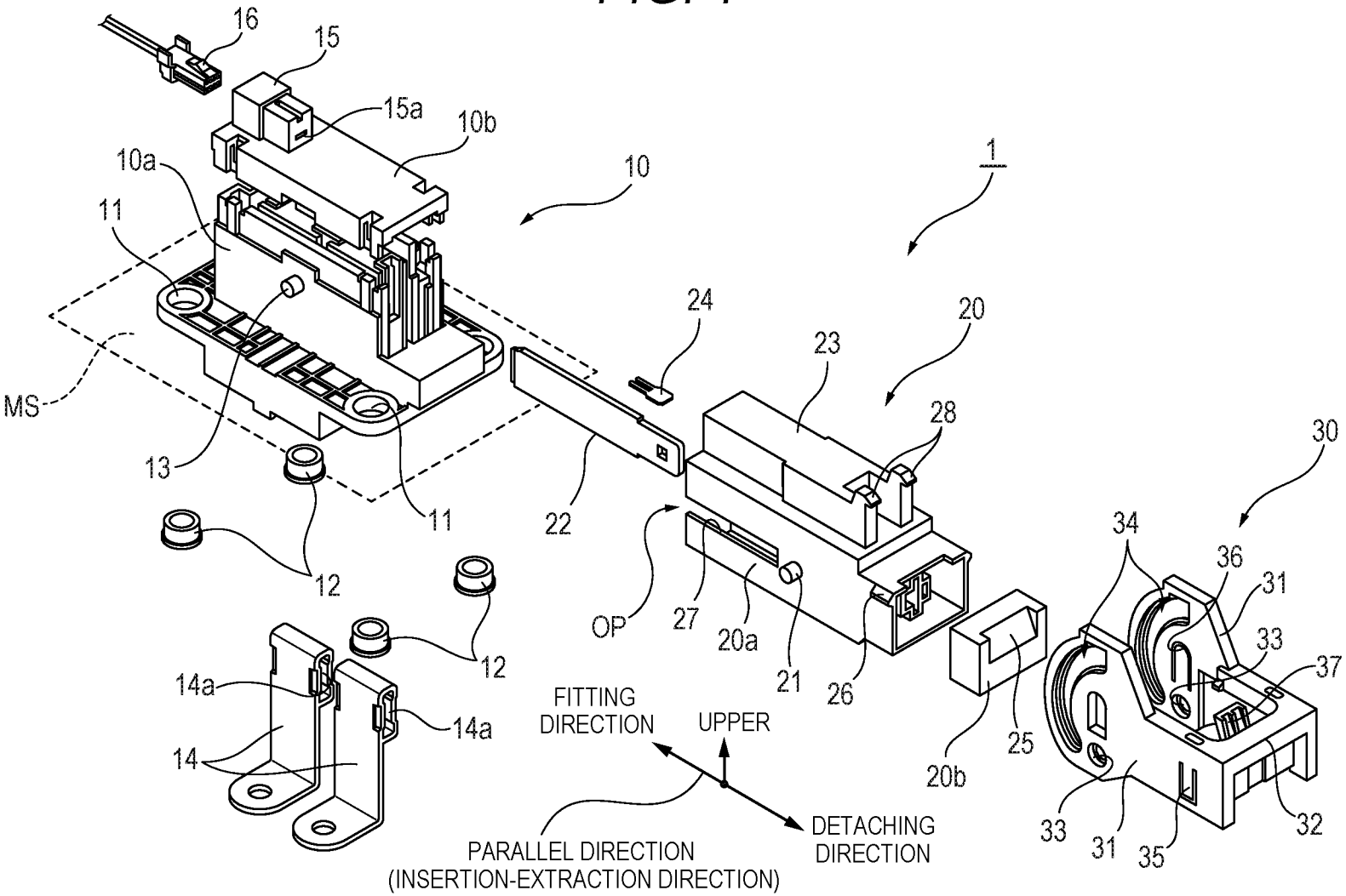
FIG. 1 is an exploded block diagram of a service plug according to an embodiment.

FIGS. 1 to 7 are block diagrams showing a service plug according to an embodiment. As FIG. 1 shows, a service plug 1 according to the embodiment is provided somewhere between a vehicle battery and a load and includes a first connector housing 10, a second connector housing 20 and a lever 30.

The first connector housing 10 constitutes a connector that is mounted on a mounting surface MS of a vehicle or the like to be fixed thereto. The second connector housing 20 constitutes a mating connector that is fitted over the first connector housing 10. The lever 30 applies a fitting force and a removing force to the second connector housing 20 to fit and remove the second connector housing 20 over and from the first connector housing 10. It should be noted that in this embodiment, operating the lever 30 moves the second connector housing 20 in a parallel direction to the mounting surface MS. Hereinafter, the relevant constituent elements will be described in detail.

Figure 2:
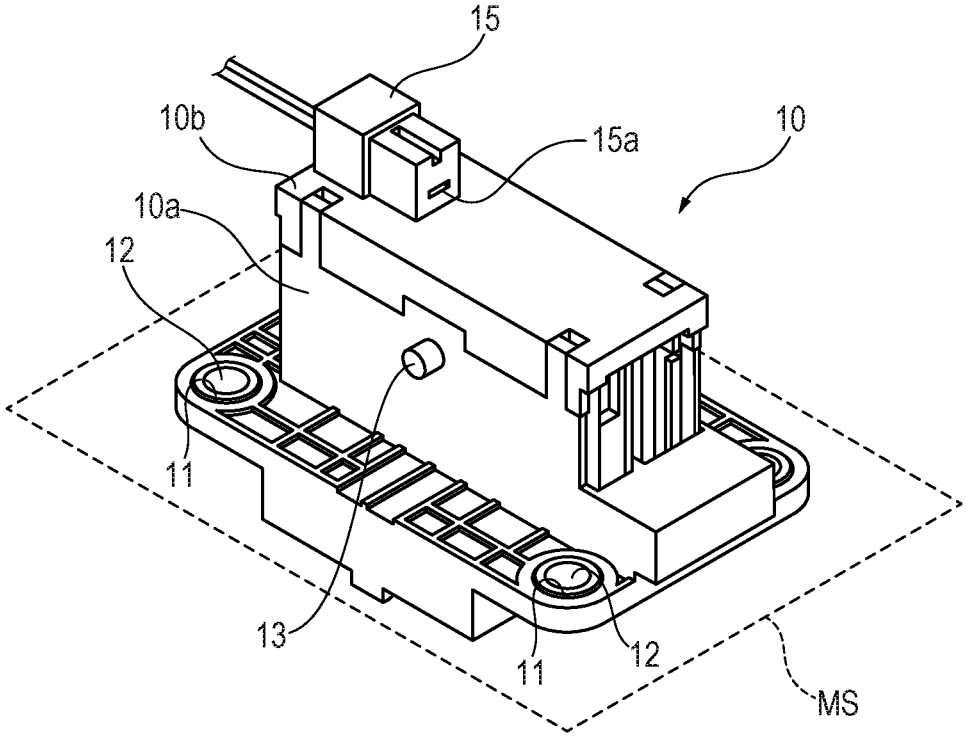
FIG. 2 is a perspective view showing a first connector housing of the service plug shown in FIG. 1.

The first connector housing 10 shown in FIGS. 1 and 2 includes a main body portion 10*a* and a cover member 10*b*. In the main body portion 10*a*, four mounting openings 11 (only two of them are shown in the perspective views) are formed with which the main body portion 10*a* is mounted on the mounting surface MS. Collars 12 are mounted in the corresponding mounting openings 11 for bolts to be tightened.

The main body portion 10 includes cam pins 13 that are provided individually on both side surfaces thereof. The cam pins 13 are designed to fit in corresponding cam grooves (refer to reference numeral 34) in the lever 30, which will be described later. Additionally, the first connector housing 10 has two female terminals 14 accommodated in an interior thereof.

The two female terminals 14 are formed of a conductive metallic plate and include at their distal end sides substantially quadrangular tubular portions 14*a* into which a male terminal (refer to reference numeral 22), which will be described later, is inserted. These two female terminals 14 are fixedly mounted within the first connector housing 10 so that the tubular portions 14*a* are aligned in the same axis. A plurality of projections 14*b* (refer to FIG. 8, which will be described later) are provided in each of the tubular portions 14*a* so as to project inwards of the tubular portion 14*a*. The plurality of projections 14*b* constitute a contact portion with the male terminal.

Further, the cover member 10*b* is mounted on an upper portion of the main body portion 10*a*. A hood portion 15 is formed on the cover member 10*b* at a fitting direction side thereof. The hood portion 15 is designed so that an interlock connector 16 is inserted into the hood portion 15 to be fixed in place therein from the fitting direction side. The hood portion 15 has an insertion opening 15*a* in an end face on a removing direction side thereof so that an interlock terminal (refer to reference numeral 24), which will be described later, is inserted into the hood portion 15 from the insertion opening 15*a* to be fixed in place in the hood portion 15. Two signal terminals, not shown, are provided inside the interlock connector 16.

Although the illustration thereof is omitted, the two signal terminals inside the interlock connector 16 connect to a switch portion that is provided on an electric current path from the vehicle battery to the load. When the two signal terminals are electrically connected together to be energized, the switch portion is on to energize the electric current path. On the other hand, when the two signal terminals are electrically disconnected from each other to be de-energized, the switch portion is off to de-energize the electric current path.

Figure 3:
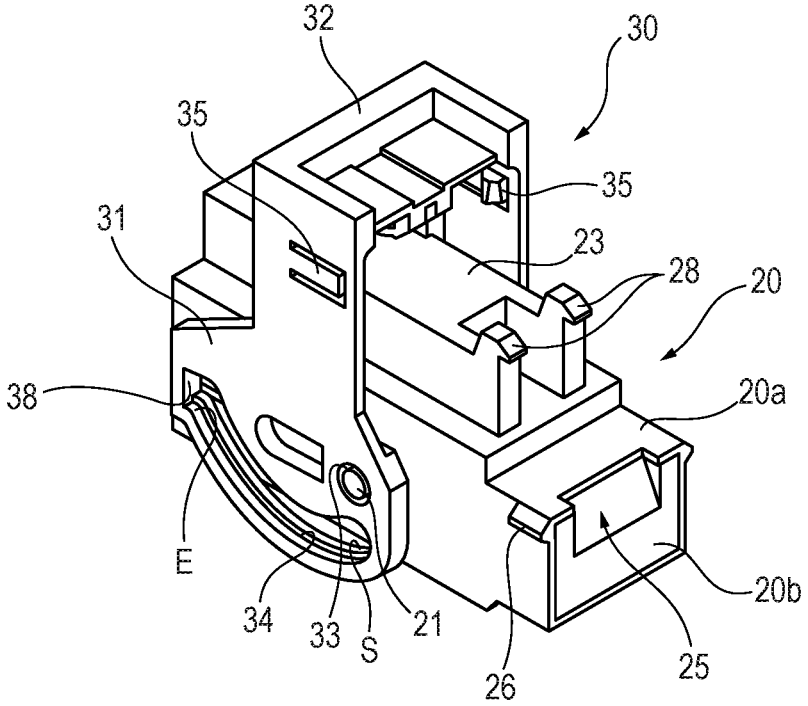
FIG. 3 is a perspective view showing a second connector housing and a lever of the service plug shown in FIG. 1.

The second connector housing 20 shown in FIGS. 1 and 3 includes a main body portion 20*a* and a rear cover 20*b*. The main body portion 20*a* includes rotational shafts 21 on both side surfaces thereof. The rotational shafts 21 are configured to fit in corresponding rotational shaft bearings (refer to reference numeral 33), which will be described later, formed in the lever 30 and constitute a rotational center of the lever 30.

The second connector housing 20 configured in the way described above includes a fitting compartment OP that opens to the fitting direction side. A male terminal 22 is fixedly mounted and accommodated in the fitting compartment OP. The male terminal 22 is formed from a conductive metallic plate and can be inserted into both the tubular portions 14*a* of the two female terminals 14. The male terminal 22 moves in fitting and removing directions as the second connector housing 20 moves in those directions so that the male terminal 22 is inserted into both the tubular portions 14*a* and is removed from the tubular portion 14*a* of the two tubular portions 14*a* (as will be described later, the male terminal 22 is removed from one of the tubular portions 14*a* but still remains inserted in the remaining tubular portion 14*a*).

The second connector housing 20 also includes a hood portion 23 on an upper portion thereof. The hood portion 23 is configured to fitted on the hood portion 15 of the first connector housing 10 and includes an interlock terminal 24 in an interior thereof. This interlock terminal 24 is made from a conductive metallic material and moves in the fitting and removing directions as the second connector housing 20 moves in those directions so that the interlock terminal 24 is inserted into and removed from the interlock connector 16 inside the hood portion 15. In the case where the interlock terminal 24 is inserted into the interlock connector 16, the two signal terminals are electrically connected together via the interlock terminal 24. This switches on the switch portion provided on the electric current path extending from the vehicle battery to the load, whereby the electric current path is energized.

The rear cover 20*b* is a member that is mounted from a removing direction side of the main body portion 20*a*. This rear cover 20*b* has formed thereon a receding portion 25 configured to prevent an elastic piece (refer to reference numeral 37), which will be described later, from coming into contact with the rear cover 20*b*.

The lever 30 includes a pair of arm plates 31 and a connecting portion 32 that connects together end portions of the pair of arm plates 31. Rotational shaft bearings 33 are formed individually on the pair of arm plates 31 so that the rotational shafts 21 of the second connector housing 20 fit therein. Further, cam grooves 34 are formed individually on the pair of arm plates 31 so that the cam pins 13 formed on the first connector housing 10 fit therein. The lever 30 rotates about the rotational shafts 21 with the cam pins 13 are moving in the corresponding cam grooves 34 in such a state that the cam pins 13 fit in the cam grooves 34 (refer to FIGS. 5 to 7).

Figure 4:
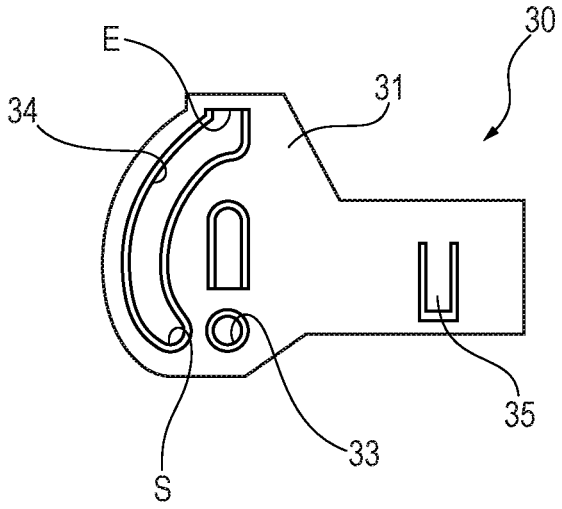
FIG. 4 is a plan view of the lever of the service plug shown in FIG. 1.
Figure 5:
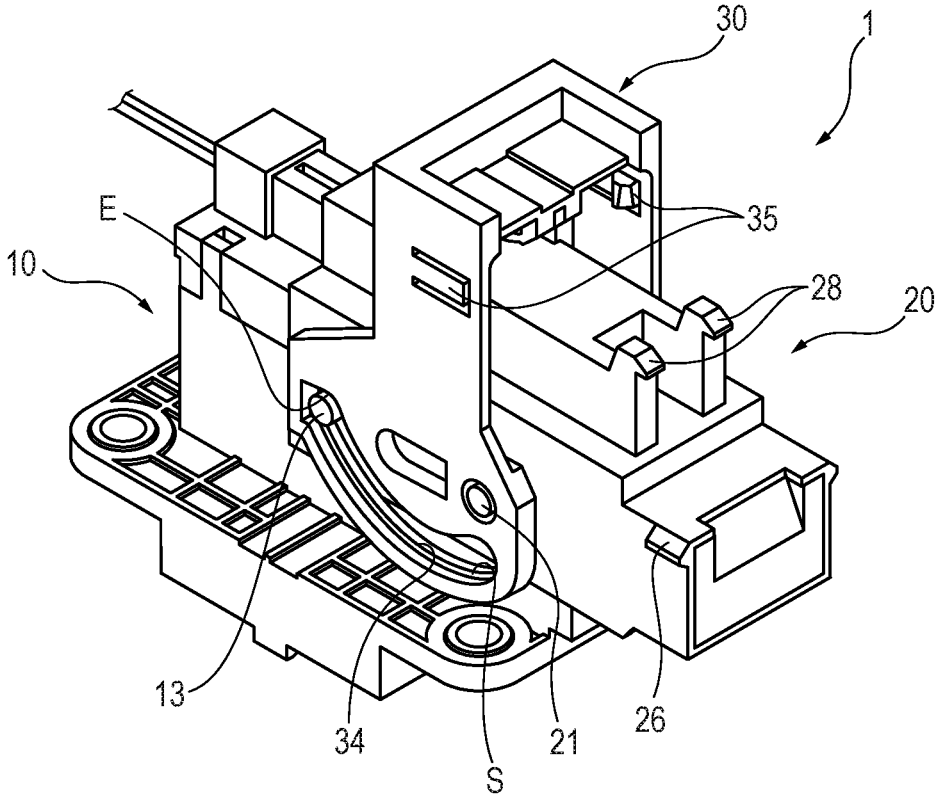
FIG. 5 is a perspective view of the service plug shown in FIG. 1 when the lever is in a first operating position.

As FIG. 4 shows, the cam groove 34 formed in the arm plate 31 has a curved structure in which a distance from the rotational shaft bearing 33 changes gradually. When the lever 30 is rotated, the curved structure allows the cam pin 13 to move towards or away from the rotational shaft 21. Namely, a fitting force and a removing force are applied to the second connector housing 20 in cooperation of the cam pins 13 with the cam grooves 34.

To describe this specifically, when the lever 30 is in a first operating position (refer to FIG. 5), that is, when the lever 30 is perpendicular to the mounting surface MS, the cam pins 13 are positioned at terminating end portions E of the cam grooves 34 (portions of the cam grooves 34 that lie farthest from the rotational shafts 21), whereby the second connector housing 20 is left in a non-fitted state over the first connector housing 10. On the other hand, when the lever 30 is in a second operating position (refer to FIG. 6), that is, when the lever 30 is left parallel to the mounting surface MS, the cam pins 13 are positioned at the other end portions S of the cam grooves 34 (portions of the cam grooves 34 that lie closest to the rotational shafts 21), whereby the second connector housing 20 is left fitted over the first connector housing 10.

Thus, when the lever 30 is rotated between the first operating position and the second operating position, the fitting force and the removing force are applied to the second connector housing 20, whereby the second connector housing 20 is brought into a fitted state and a non-fitted state relative to the first connector housing 10.

Figure 7:
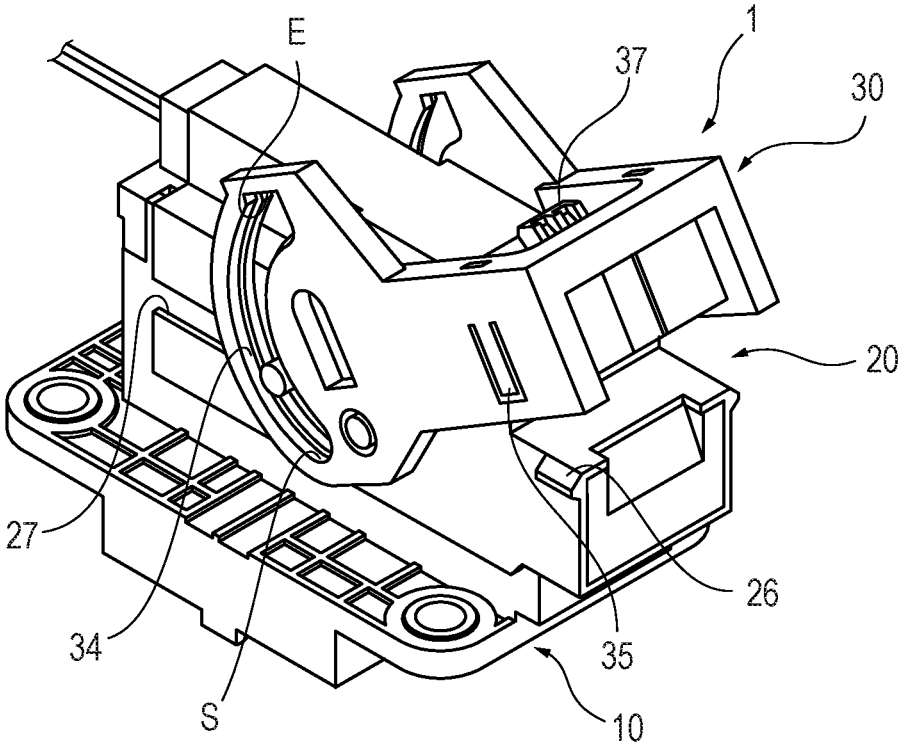
FIG. 7 is a perspective view of the service plug shown in FIG. 1 when the lever is in a third operating position.

Here, the lever 30 is configured to take a third operating position between the first operating position and the second operating position (refer to FIG. 7). Further, locking devices are provided on the lever 30 and the second connector housing 20, so that their relative positions can be held in the first operating position, the second operating position and the third operating position. Hereinafter, this feature will be described in detail.

Firstly, as FIG. 1 shows, the lever 30 includes projecting portions 36 formed on inner surfaces of the pair of arm plates 31. The projecting portions 36 are configured to be elastically deformed substantially in a perpendicular direction with respect to flat planes of the arm plates 31. Additionally, grooves 27 extending in the fitting and removing directions are formed in the second connector housing 20. With the lever 30 staying in the first operating position shown in FIG. 5, that is, with the second connector housing 20 left in the non-fitted state relative to the first connector housing 10, the projecting portions 36 fit in the corresponding grooves 27, whereby the projecting portions 36 and the grooves 27 play their role of holding the lever 30 in the first operating position. The engagement of the projecting portions 36 with the grooves 27 can be released by a rotating operation of the lever 30 by the operator.

In addition, as FIGS. 1 and 3 show, locking pieces 35 are formed on the pair of arm plates 31 at portions lying near the connecting portion 32 so as to be elastically deformed substantially in the perpendicular direction with respect to the flat planes of the arm plates 31. Further, the second connector housing 20 includes locking claws 26 formed at the removing direction side thereof so as to project sideways.

Figure 6:
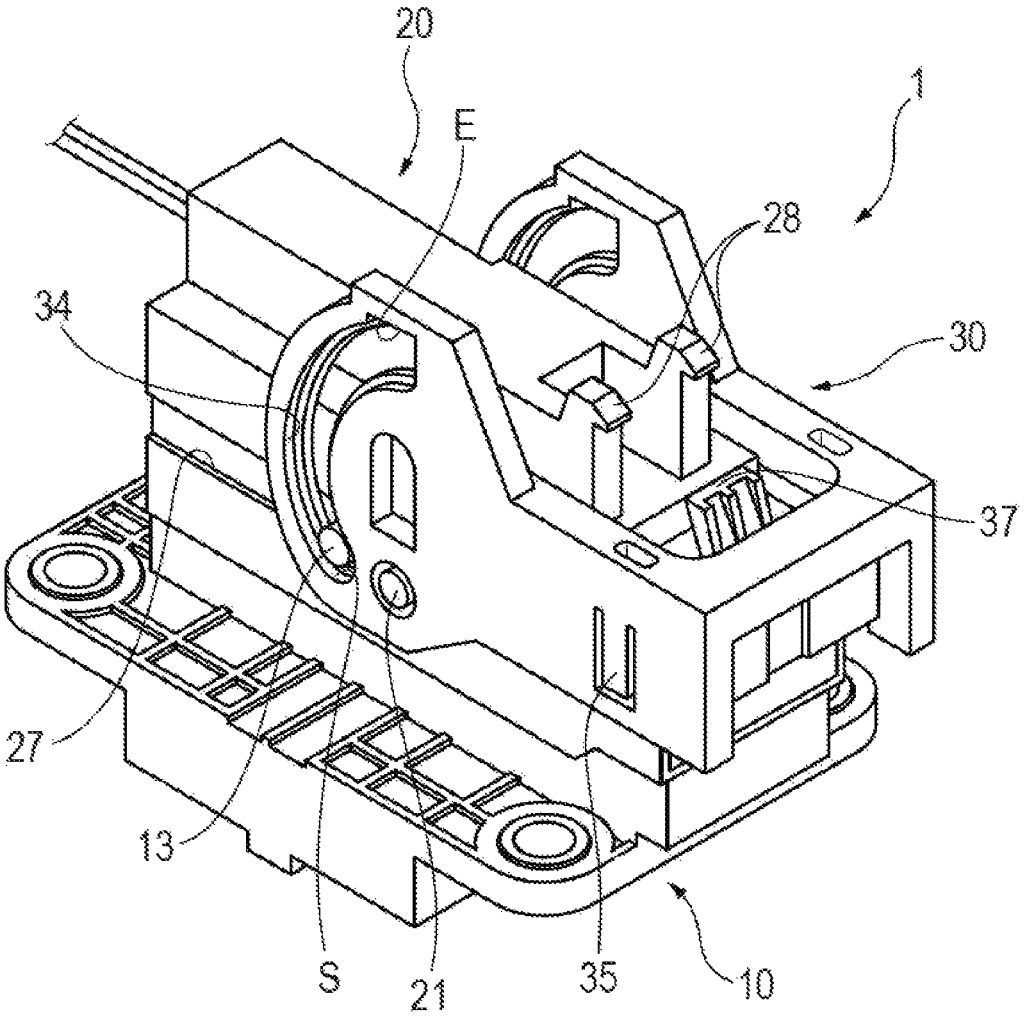
FIG. 6 is a perspective view of the service plug shown in FIG. 1 when the lever is in a second operating position.

With the lever 30 staying the second operating position shown in FIG. 6, that is, with the second connector housing 20 left in the fitted state relative to the first connector housing 10, these locking pieces 35 and the locking claws 26 play their role of holding the lever 30 in the second operating position.

The engagement of the locking pieces 35 with the locking claws 26 is in such an extent that the engagement can be released by a rotating operation of the lever 30 by the operator. Namely, the operator can release the engagement of the locking pieces 35 with the locking claws 26 by rotating the lever 30 from the second operating position towards the first operating position (the third operating position).

Further, as FIG. 1 show, the lever 30 includes an elastic piece 37 formed on an inner surface of the connecting portion 32. The elastic piece 37 is a plate member (refer to FIGS. 8 to 10, which will be described later) having a J-shape in section is made to be elastically deformed towards the connecting portion 32. The second connector housing 20 includes two locking claws 28 that are positioned slightly further forwards in the fitting direction and further upwards than the locking claws 26. The locking claws 28 are formed to project in the removing direction. The elastic piece 37 is made to be brought into engagement with the locking claws 28 on a surface lying closer to a rotational center thereof.

With the lever 30 staying the third operating position shown in FIG. 7, that is, with the second connector housing 20 left in a half-fitted state relative to the first connector housing 10, these elastic piece 37 and locking claws 28 play their role of holding the lever 30 in the third operating position.

The engagement of the elastic piece 37 with the locking claws 28 is in such an extent that the engagement cannot be released by a rotating operation of the lever 30 by the operator. Namely, even though the operator rotates the lever 30 from the third operating position towards the first operating position, the operator cannot release the engagement of the elastic piece 37 with the locking claws 28. In the case where the operator wants to rotate the lever 30 to the first operating position, the operator operates directly the elastic piece 37 to deflect it towards the connecting portion 32. This releases the engagement of the elastic piece 37 with the locking claws 28. The operator can rotate the lever 30 to the first operating position by rotating the lever 30 so while holding the released state.

Here, in this embodiment, the lever 30 includes a preventive wall 38 (refer to FIG. 3). The preventive wall 38 is a wall portion that is provided at the terminating end portion E of the cam groove 34 to prevent the cam pin 13 in the cam groove 34 from being dislocated in a moving direction of the second connector housing 20 from the fitted state to the non-fitted state with the lever 30 staying in the first operating position.

The service plug 1 according to the embodiment that is configured in the way described above is not constructed on the premise that the second connector housing 20 and the lever 30 are removed from the first connector housing 10. Namely, although a cam pin entrance opening (a thin portion) is formed at a terminating end portion of a cam groove in the lever described in Patent Document 1, such an entrance opening is formed in this embodiment, and the cam pins 13 are basically designed so as not to be dislocated from the corresponding cam grooves 34. This allows the lever 30 to fit on both the cam pins 13 and the rotational shafts 21, whereby the first connector housing 10 and the second connector housing 20 are made integral with each other via the lever 30, resulting in the construction that is designed on the premise that the lever 30 and the second connector housing 20 remain integral with the first connector housing 10.

Figure 8:
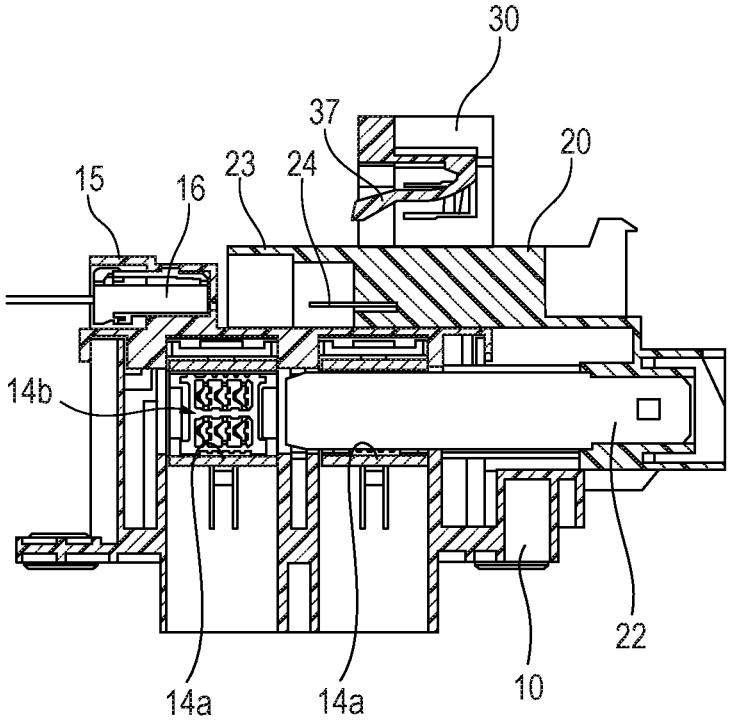
FIG. 8 is a sectional view of the service plug shown in FIG. 1 when the lever is in the first operating position.
Figure 9:
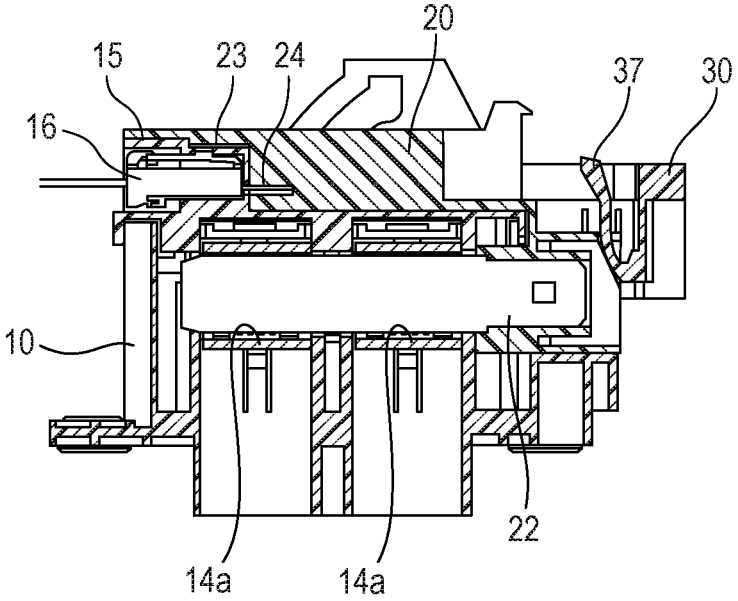
FIG. 9 is a sectional view of the service plug shown in FIG. 1 when the lever is in the second operating position.
Figure 10:
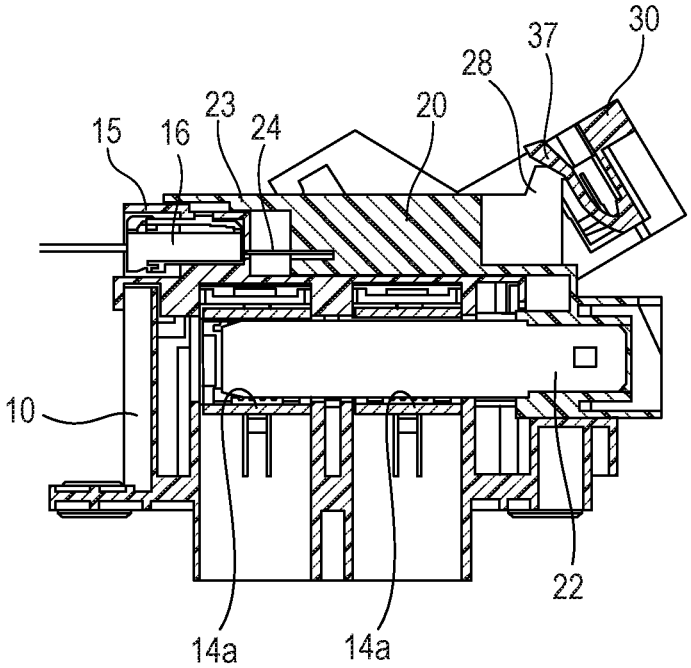
FIG. 10 is a sectional view of the service plug shown in FIG. 1 when the lever is in the third operating position.

FIG. 8 is a sectional view of the service plug 1 shown in FIG. 1 when the lever 30 stays in the first operating position. FIG. 9 is a sectional view of the service plug 1 shown in FIG. 1 when the lever 30 stays in the second operating position. FIG. 10 is a sectional view of the service plug 1 shown in FIG. 1 when the lever 30 stays in the third operating position.

Next, an operation will be described in which the second connector housing 20 is moved from the non-fitted state to the fitted state. Firstly, the operator forcibly opens an opposite end portion (a rotational center side end portion) to the connecting portion 32 of the lever 30. Then, as the lever 30 restores its original shape, the rotational shafts 21 fit in the corresponding rotational shaft bearings 33, and the cam pins 13 fit in the corresponding cam grooves 34. The cam pins 13 are fitted so as to be positioned at the terminating end portions E of the cam grooves 34. The second connector housing 20 is in the non-fitted state shown in FIG. 5 at this point in time.

Next, the operator rotates the lever 30 towards the second operating position. This causes the cam pins 13 to move towards the other end portions S in the cam grooves 34. In particular, the cam grooves 34 are formed so that the distance from the rotational shaft bearing 33 becomes shorter gradually towards the other end portion S, due to which a fitting force acts on the second connector housing 20 in the fitting direction on the first connector housing 10, whereby the second connector housing 20 comes to be fitted on the first connector housing 10 gradually as the lever 30 is rotated.

Then, when the lever 30 arrives at the third operating position, the elastic piece 37 is brought into engagement with the locking claws 28 (refer to FIG. 10). In this state, the second connector housing 20 is in the half-fitted state in which the male terminal 22 is inserted into both the tubular portions 14*a* of the two female terminals 14 to thereby be in contact with the two female terminals 14. On the other hand, in this half-fitted state, the hood portion 23 of the second connector housing 20 has not yet been fitted on the hood portion 15 of the first connector housing 10. Due to this, the interlock terminal 24 within the hood portion 23 has not yet been inserted perfectly in the interlock connector 16 within the hood portion 15, and the switch portion, not shown, is left off. Namely, the electric current path from the vehicle battery to the load is in a cut-off state.

Thereafter, when the operator further rotates the lever 30 towards the second operating position, the lever 30 arrives at the second operating position, and the locking pieces 35 are brought into engagement with the corresponding locking claws 26. In this state, the second connector housing 20 is in the fitted state, and the male terminal 22 is inserted into both the tubular portions 14*a* of the two female terminals 14 to thereby be in contact with the female terminals 14 (refer to FIG. 9). Further, in the fitted state, the hood portion 23 of the second connector housing 20 is fitted on the hood portion 15 of the first connector housing 10. Thus, the interlock terminal 24 within the hood portion 23 is inserted completely into the interlock connector 16 within the hood portion 15, whereby the switch portion, not shown, is switched on. Namely, the electric current path from the vehicle battery to the load is energized.

Next, an operation will be described in which the second connector housing 20 is moved from the fitted state to the non-fitted state. Firstly, let's assume that the second connector housing 20 is in the fitted state with the lever 30 staying in the second operating position. The operator rotates the lever 30 from this state towards the first operating position (the third operating position). This causes the cam pins 13 to move towards the terminating end portions E in the cam grooves 34. In particular, the cam grooves 34 are formed so that the distance from the rotational shaft bearing 33 becomes longer gradually towards the terminating end portion E, due to which a removing force acts on the second connector housing 20 in the removing direction on the first connector housing 10, whereby the second connector housing 20 comes to move away from the first connector housing 10 gradually as the lever 30 is rotated. The engagement of the locking pieces 35 with the locking claws 26 and the engagement of the projecting portions 36 with the grooves 27 are released when the lever 30 is started to be rotated.

Thereafter, when the lever 30 arrives at the third operating position, the elastic piece 37 is brought into engagement with the locking claws 28 (refer to FIG. 10). In this state, the second connector housing 20 is in the half-fitted state. Although the male terminal 22 is left inserted in both the tubular portions 14*a* of the two female terminals 14 to thereby be left in contact with the female terminals 14, the interlock terminal 24 is not inserted completely in the interlock connector 16, whereby the switch portion, not shown, is switched off. Namely, the electric current path from the vehicle battery to the load is de-energized.

Here, even though the operator rotates the lever 30 towards the first operating position, due to the engagement of the elastic piece 37 with the locking claws 28, the operator cannot release the engaged state occurring between the relevant constituent parts. Then, the operator operates directly the elastic piece 37 to deflect it towards the connecting portion 32. This releases the engagement of the elastic piece 37 with the locking claws 28. Thereafter, the operator rotates the lever 30 towards the first operating position while holding the released state.

When the lever 30 arrives at the first operating position, the second connector housing 20 is in the non-fitted state. Due to this, as FIG. 8 shows, although the male terminal 22 is left inserted in one of the tubular portions 14*a* of the two female terminals to thereby be left in contact with one of the two female terminals 14, the male terminal 22 is no more inserted in the other tubular portion 14*a* to thereby be disconnected from the other female terminal 14. In this way, the male terminal 22 is electrically connected only with one female terminal 14 while being electrically disconnected from the other female terminal 14. Thus, the electric current path from the vehicle battery to the load is left in the cut-off state. Further, the interlock terminal 24 is no more inserted in the interlock connector 16, whereby the switch portion, not shown, is switched off.

Here, the operator holds the lever 30 or the second connector housing 20 to attempt to move the second connector housing 20 in the removing direction. In this case, since the lever 30 according to the embodiment includes the preventive walls 38 that are provided at the terminating end portions E of the cam grooves 34 to prevent the dislocation of the cam pins 13 in the removing direction as shown in FIG. 3, the cam pins 13 are brought into contact with the corresponding preventive walls 38 to thereby be prevented from being dislocated from the grooves 34. Namely, the second connector housing 20 and the lever 30 are basically not removed from the first connector housing 10, thereby obviating the necessity of a space for removal. Additionally, a risk of the removal part such as the second connector housing 20 and the lever 30 dropping to be damaged for unavailability or a risk of a foreign matter intruding into the first connector housing 10 is eliminated.

In this way, with the service plug 1 according to the embodiment, the preventive walls 38 are provided at the terminating end portions E of the cam grooves to prevent the dislocation of the cam pins 13 in the cam grooves 34 therefrom when the lever 30 stays in the first operating position. Thus, even though the operator attempts to remove the second connector housing 20, the operator cannot remove easily the second connecting housing 20 as a result of the cam pins 13 being prevented from being dislocated by the preventive walls 38. Consequently, the second connector housing 20 can be basically prevented from being removed from the first connector housing 10, thereby obviating the necessity of a space for removal. Additionally, the second connector housing 20 is basically prevented from being removed from the first connector housing 10, and therefore, there is no fear of the removal part dropping or a foreign matter intruding into the first connector housing 10. Consequently, the necessity of providing a space for removal can be obviated, and a risk of the removal part dropping to be damaged for unavailability or a risk of a foreign matter intruding into the first connector housing 10 can be prevented from occurring.

Additionally, the second connector housing 20 moves in the parallel direction to the mounting surface MS where the first connector housing 10 is mounted, and therefore, this configuration can contribute to reducing further the required space on the service plug 1 when compared with a case where the second connector housing 20 is displaced perpendicularly to the mounting surface MS.

The male terminal 22 is inserted only in the tubular portion 14*a* of one of the two female terminals 14 to thereby be disconnected from the other female terminal 14 when the lever 30 stays in the first operating position. Due to this, when compared with a case where the male terminal 22 is dislocated from the tubular portions 14*a* of both the female terminals 14 when the lever 30 stays in the first operating position, the displacement amount of the second connector housing 20 in the parallel direction is reduced, whereby this configuration can contribute to reducing further the required space on the circumference of the service plug 1.

Thus, while the invention has been described heretofore based on the embodiment, the invention is not limited to the embodiment. Hence, a modification may be made to the embodiment or the techniques described in the embodiment may be combined as required without departing from the spirit and scope of the invention. Further, the embodiment may be combined with other possible or permissible techniques as required.

For example, while the service plug 1 according to the embodiment moves in the parallel direction to the mounting surface MS, the invention is not limited thereto, and hence, the service plug 1 may be configured to move in a vertical direction. Further, while the male terminal 22 is configured to be electrically connected only to one of the female terminals 14 while being disconnected from the other female terminal 14 in the non-fitted state, the invention is not limited thereto, and hence, the male terminal 22 may be configured to be electrically disconnected from both the female terminals 14 in the non-fitted state.

In accordance with the embodiments as shown in the drawings, a service plug includes a first connector housing 10 including a cam pin 13, a second connector housing 20 on which a rotatable shaft 21 is provided, and a lever 30 that is rotatable about the rotational shaft 21. The lever 30 includes a cam groove 34 in which the cam pin 13 fits. The lever 30 is movable between a first operating position and a second operating position. The second connector housing 20 is in a non-fitted state with respect to the first connector housing 10, when the lever 30 is in the first operating position. The second connector housing 20 is in a fitted state with respect to the first connector housing 10, when the lever is in the second operating position. The lever 30 includes a preventive wall 38 at a terminating end portion E of the cam groove 34. The preventive wall 38 is configured to prevent the cam pin 13 from ejecting from the cam groove 34 in a moving direction of the second connector housing 20 from the fitted state to the non-fitted state when the lever 30 is in the first operating position.

With this service plug, even when the operator attempts to remove the second connector housing with the lever located in the first operating position, due to the service plug having at the terminating end portion of the cam groove the preventive wall configured to prevent the dislocation of the cam pin in the cam groove, the operator cannot remove easily the second connector housing as a result of the preventive wall preventing the dislocation of the cam pin. This basically makes it impossible for the second connector housing to be removed, thereby obviating the necessity of a space for removal. In addition, due to the service plug having the configuration in which the second connector housing is basically prevented from being removed, there is no risk of the removal part dropping or a foreign matter intruding into the first connector housing. Thus, the space for removal becomes unnecessary, and the removal part can be prevented from dropping to be damaged for unavailability, or a foreign matter can be prevented from intruding into the interior of the first connector housing.

In the service plug, the second connector housing 20 moves in a parallel direction to a mounting surface MS on which the first connector housing 10 is mounted.

With the service plug configured in the way described above, the second connector housing moves in the parallel direction to the mounting surface on which the first connecting housing is mounted. This configuration of the service plug can contribute further to reducing the required space on the service plug when compared with a case where the second connector housing moves in a vertical direction in relation to the mounting surface.

In the service plug, the first connector housing 10 accommodates therein two female terminals 14. Each of the two female terminals 14 includes a tubular portion 14*a* opening in the parallel direction. The tubular portions 14*a* of the two female terminals 14 are disposed along a single axis. The second connector housing 20 accommodates therein a male terminal 22. The male terminal 22 is inserted into both the two female terminals 14*a* and is brought into contact with both the two female terminals 14*a*, when the lever 30 is in the second operating position. The male terminal 22 is inserted into the tubular portion 14*a* of one of the two female terminals 14 and is brought into contact with the one of female terminals 14 but is not inserted into the tubular portion 14*a* of the other of the female terminals 14 and is left disconnected from the other of the female terminals, when the lever 30 is in the first operating position.

With the service plug configured in the way described above, the male terminal is inserted only into the tubular portion of one of the two female terminals to thereby be disconnected from the other female terminal when the lever is in the first operating position. This reduces the displacement amount of the second connector housing in the parallel direction when compared with a case where the male terminal is dislocated from the tubular portions of both the female terminals with the lever located in the first operating position, whereby the service plug can contribute further to reducing the required space on the circumference thereof.

According to the embodiments, the service plug would obviate the necessity of the space for removal and that can prevent the removal part from dropping to be damaged for unavailability or a foreign matter from intruding into the interior of the first connector housing.

DESCRIPTION OF REFERENCE NUMERALS AND CHARACTERS

1: service plug
10: first connector housing
13: cam pin
14: female terminal
14*a*: tubular portion
20: second connector housing
21: rotational shaft
22: male terminal
30: lever
34: cam groove
38: preventive wall
E: terminating portion
MS: mounting surface

What is claimed is:

1. A service plug comprising:

a first connector housing including a cam pin;

a second connector housing on which a rotatable shaft is provided; and a lever that is rotatable about the rotational shaft, wherein the lever includes a cam groove in which the cam pin fits, wherein the lever is movable between a first operating position and a second operating position, wherein the second connector housing is in a non-fitted state with respect to the first connector housing, when the lever is in the first operating position, wherein the second connector housing is in a fitted state with respect to the first connector housing, when the lever is in the second operating position, wherein the lever includes a preventive wall at a terminating end portion of the cam groove, the preventative wall being fixed relative to the cam groove, and wherein the preventive wall is configured to prevent the cam pin from ejecting from the cam groove in a moving direction of the second connector housing from the fitted state to the non-fitted state when the lever is in the first operating position.

2. The service plug according to claim 1, wherein the second connector housing moves in a parallel direction to a mounting surface on which the first connector housing is mounted.

3. The service plug according to claim 1, wherein the first connector housing accommodates therein two terminals, and wherein the two terminals are electrically connected to each other when the lever is in the second operating position.

4. The service plug according to claim 1, wherein the preventative wall is formed to extend, in a height direction that the cam pin protrudes, at least a distance that a height of the cam groove extends.

5. The service plug according to claim 1, wherein the first connector housing accommodates therein a plurality of female terminals, wherein the second connector housing accommodates therein a male terminal, wherein the male terminal is inserted into at least one of the plurality of female terminals and is brought into contact with the at least one of the plurality of female terminals but is not inserted into another of the plurality of female terminals and is left disconnected from the other of the plurality of female terminals, when the lever is in the first operating position.

6. A service plug comprising:

a first connector housing including a cam pin;

a second connector housing on which a rotatable shaft is provided; and a lever that is rotatable about the rotational shaft, wherein the lever includes a cam groove in which the cam pin fits, wherein the lever is movable between a first operating position and a second operating position, wherein the second connector housing is in a non-fitted state with respect to the first connector housing, when the lever is in the first operating position, wherein the second connector housing is in a fitted state with respect to the first connector housing, when the lever is in the second operating position, wherein the lever includes a preventive wall at a terminating end portion of the cam groove, and wherein the preventive wall is configured to prevent the cam pin from ejecting from the cam groove in a moving direction of the second connector housing from the fitted state to the non-fitted state when the lever is in the first operating position, wherein the second connector housing moves in a parallel direction to a mounting surface on which the first connector housing is mounted, wherein the first connector housing accommodates therein two female terminals, wherein each of the two female terminals includes a tubular portion opening in the parallel direction, wherein the tubular portions of the two female terminals are disposed along a single axis, wherein the second connector housing accommodates therein a male terminal, wherein the male terminal is inserted into both the two female terminals and is brought into contact with both the two female terminals, when the lever is in the second operating position, and wherein the male terminal is inserted into the tubular portion of one of the two female terminals and is brought into contact with the one of female terminals but is not inserted into the tubular portion of the other of the female terminals and is left disconnected from the other of the female terminals, when the lever is in the first operating position.

* * * * *